US006500326B1

(12) United States Patent
Warnecke

(10) Patent No.: US 6,500,326 B1
(45) Date of Patent: Dec. 31, 2002

(54) METHOD OF INTERNALLY COATING A WEAPON BARREL

(75) Inventor: Christian Warnecke, Celle (DE)

(73) Assignee: Rheinmetall W & M GmbH, Unterlüss (DE)

( * ) Notice: Subject to any disclaimer, the term of this patent is extended or adjusted under 35 U.S.C. 154(b) by 212 days.

(21) Appl. No.: 09/709,651

(22) Filed: Nov. 13, 2000

(30) Foreign Application Priority Data

Nov. 13, 1999 (DE) ..... 199 54 652

(51) Int. Cl.[7] ..... C25D 5/02
(52) U.S. Cl. ..... 205/131; 205/118
(58) Field of Search ..... 205/131, 118

(56) References Cited

U.S. PATENT DOCUMENTS 4,590,033 A 5/1986 Chapet ..... 419/9
5,538,615 A * 7/1996 Palumbo et al. ..... 205/115
6,352,600 B1 * 3/2002 Alexander ..... 148/516

FOREIGN PATENT DOCUMENTS

DE 39 07 087 9/1990

* cited by examiner

*Primary Examiner*—Nam Nguyen
*Assistant Examiner*—Erica Smith-Hicks
(74) *Attorney, Agent, or Firm*—Venable; Norman N. Kunitz

(57) ABSTRACT

A method of coating an internal surface of a weapon barrel includes the steps of applying an intermediate layer to the internal barrel surface by explosion plating and applying a cover layer at least indirectly to the intermediate layer by electroplating. The intermediate layer has a heat conductivity which is greater than that of the weapon barrel and a ductility which is greater than that of the cover layer.

5 Claims, 1 Drawing Sheet

METHOD OF INTERNALLY COATING A WEAPON BARREL

CROSS REFERENCE TO RELATED APPLICATION

This application claims the priority of German Application No. 199 54 652.5 filed Nov. 13, 1999, which is incorporated herein by reference.

BACKGROUND OF THE INVENTION

This invention relates to a method of internally coating a weapon barrel. Conventionally, for preventing erosions of the weapon barrel, a cover layer of high melting point and composed of at least one material is applied by electroplating to an axial length portion of the inner barrel surface.

The firing of power-enhanced ammunition from large caliber, smooth-barrel weapons leads to prematurely strong wear of the inner barrel surface because of the high gas temperatures and flow velocities that occur during firing.

For avoiding the above-noted wear phenomena, it has been known to provide the inner weapon barrel surface with a hard chromium layer by electrolytical deposition. In most instances, however, the relatively brittle, hard chromium layers of power-enhanced ammunition applied according to the known processes do not adhere in a satisfactory manner to the barrel surface so that partial peeling of the regions provided with the chromium layer occurs. As a result, the barrel material is, in such regions, exposed to the hot combustion gases, and strong, erosion-caused wear of the barrel material occurs. Further, the substantial heating of the chromium layer upon firing of the ammunition may result in an unintentional local fusion of the chromium on the weapon barrel.

SUMMARY OF THE INVENTION

It is an object of the invention to provide an improved method of internally coating a weapon barrel with a galvanically applicable cover layer which results in a coating that prevents an erosion-caused wear of the barrel even upon firing power-enhanced ammunition.

This object and others to become apparent as the specification progresses, are accomplished by the invention, according to which, briefly stated, the method of coating an internal surface of a weapon barrel includes the steps of applying an intermediate layer to the internal barrel surface by explosion plating and applying a cover layer at least indirectly (that is, either directly or with the interposition of a further layer or layers) to the intermediate layer by electroplating. The intermediate layer has a heat conductivity which is greater than that of the weapon barrel and a ductility which is greater than that of the cover layer.

The invention is based essentially on the principle to apply to the inner surface of the weapon barrel an intermediate layer by means of explosion plating prior to applying the cover layer by electroplating. While the cover layer has the purpose of protecting the barrel material (and thus also the intermediate layer) from high gas temperatures and preventing a thermo-chemical reaction between the layer combination and the combustion gases upon firing the ammunition, the intermediate layer, based on its high heat conductivity, is intended to rapidly lower the peak temperature in the cover layer and in the surface region of the weapon barrel. For this purpose, the heat conductivity of the intermediate layer has to be greater than that of the barrel material. Further, the intermediate layer should have a higher ductility as compared to the cover layer and should prevent a spreading of fissures which appear in the cover layer so that the maximum expansion capacity of the layer combination is increased.

As materials for the cover layer pure metals, metal alloys or dispersion-reinforced metals and/or metal alloys may be used as long as they have a high melting point (preferably equal to or above 1600° C.) and are sufficiently inert to combustion gases. Chromium has been proven to be particularly advantageous as such a coating material.

The intermediate layer should be a metallic material having a high heat conductivity (preferably equal to or greater than 90 W/mK), a high ductility and a sufficient strength. In this respect pure metals, metal alloys or dispersion-reinforced metals and/or metal alloys may be considered. Copper, nickel and cobalt as well as alloys of these metals have been found to be particularly advantageous as materials for the intermediate layer.

As compared to a conventional galvanic hard chromium coating, the method according to the invention excels particularly in that based on the superior heat conductivity of the explosion-plated intermediate layer, the peak temperature in the galvanically deposited cover layer may be lowered rapidly. As a result, the thermal, thermo-mechanical and thermo-chemical stresses on the cover layer are significantly reduced. Further, the peak temperature in the boundary layer to the barrel material is reduced because of the greater total layer thickness as compared to the conventional galvanic hard chromium layer.

DESCRIPTION OF THE PREFERRED EMBODIMENT

Figure 1:
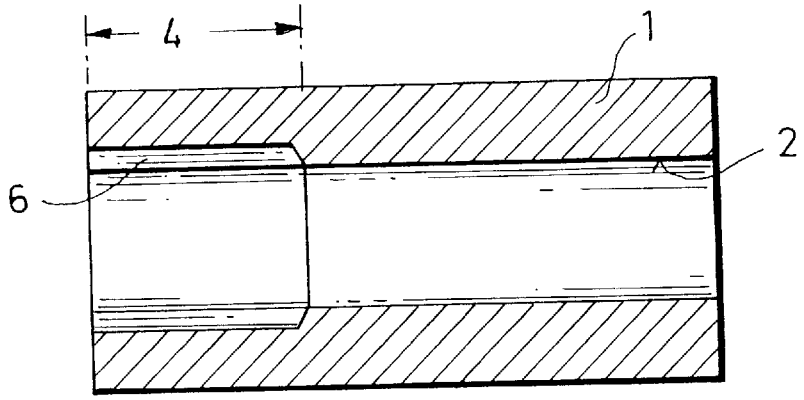
FIG. 1 is an axial sectional view of a weapon barrel portion to be coated prior to applying the coating material.

FIG. 1 shows a weapon barrel 1 which is to be coated on its inner surface 2 with a cover layer 3 (FIG. 4) made, for example, of chromium. In a partial region 4 of the weapon barrel which is exposed to particularly high temperatures, between the chromium layer 3 and the weapon barrel 1 an intermediate layer 5 (FIG. 2) is to be arranged which is applied by explosion plating, ensuring a substantial adhering strength of the intermediate layer 5 on the weapon barrel 1 without an unintentional mutual metallurgical effect taking place between the materials.

Figure 2:
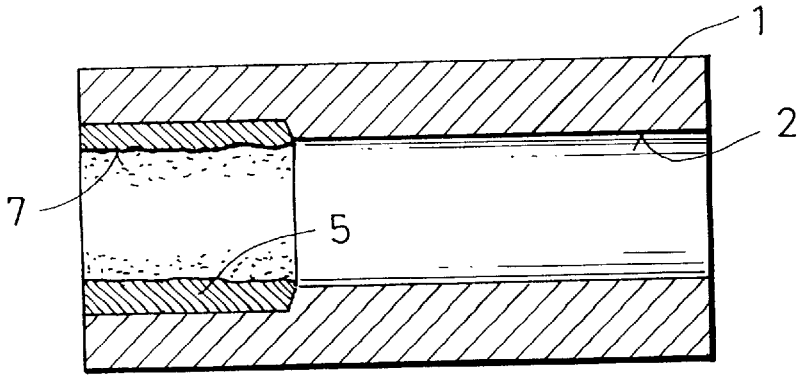
FIG. 2 shows the weapon barrel of FIG. 1 after applying an intermediate layer by explosion plating.

First, in the partial region 4 of the weapon barrel 1 a recess 6 is provided (FIG. 1), in which the intermediate layer 5 is applied by explosion plating (FIG. 2). A copper sheet or copper foil may be used as the starting material for the intermediate layer.

Figure 3:
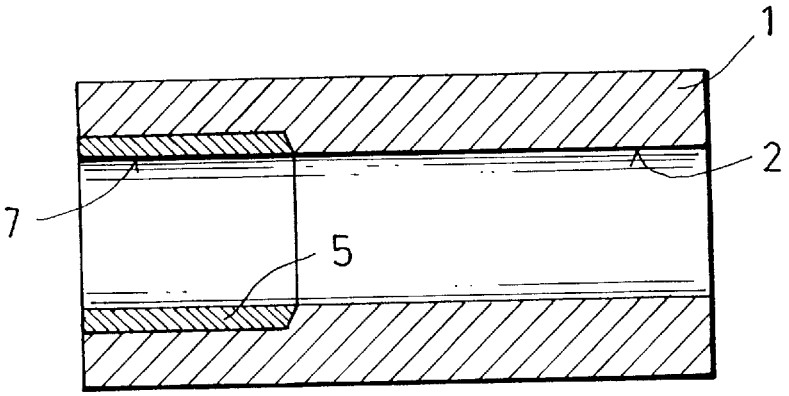
FIG. 3 shows the weapon barrel of FIG. 2 following a mechanical machining of the intermediate layer.

After the explosion plating process an electric polishing and/or mechanical working of the upper surface 7 of the intermediate layer 5 takes place until, as shown in FIG. 3, the required tolerances and surface roughness for the galvanic deposition are obtained.

Figure 4:
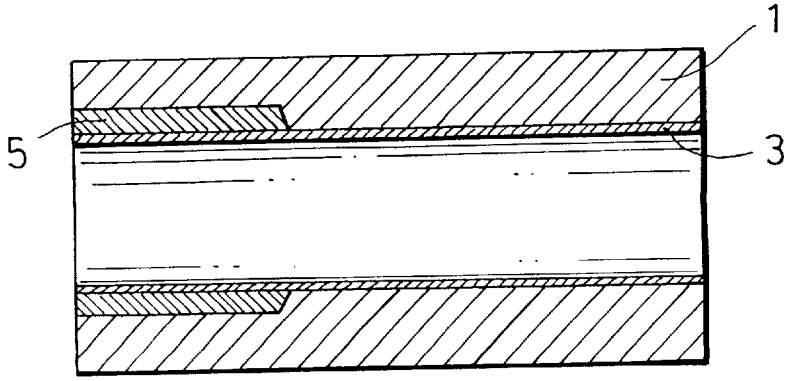
FIG. 4 shows the weapon barrel of FIGS. 1–3 subsequent to applying the cover layer.

As the final step illustrated in FIG. 4, the chromium layer 3 is galvanically deposited on the intermediate layer 5 and on the surface portion of the weapon barrel 1 which is not provided with the intermediate layer 5.

It is to be understood that the invention is not limited to the above-described exemplary embodiment. Thus, the explosion plating of the intermediate layer 5 as well as the galvanic deposition of the cover layer 3 may be applied to partial regions as well as along the entire weapon length.

In case the explosion-plated layer and the galvanic layer extend over the entire barrel length or over an identical partial region of the weapon barrel, the electro-polishing and depositing conditions have to be coordinated with the explosively plated material. If, on the contrary, only a partial region of the weapon barrel is explosively plated and a partial zone extending from such partial region is galvanically coated, the fact has to be taken into account that the electro-polishing and depositing conditions may be different for the electroplated material and for the weapon material.

If required, prior to the deposition of the cover layer on the intermediate layer, one or more galvanic intermediate layers may be applied to ensure an adherence of the cover layer, since not all desired material combinations can be suitably deposited on one another.

It will be understood that the above description of the present invention is susceptible to various modifications, changes and adaptations, and the same are intended to be comprehended within the meaning and range of equivalents of the appended claims.

What is claimed is:

1. A method of coating an internal surface of a weapon barrel comprising the following steps:

(a) applying to said surface an intermediate layer by explosion plating; said intermediate layer having a first ductility and a heat conductivity greater than a heat conductivity of said weapon barrel; and (b) applying, at least indirectly, to said intermediate layer a cover layer by electroplating; said cover layer having a second ductility; said first ductility being greater than said second ductility.

2. The method as defined in claim 1, wherein said cover layer is a chromium layer.

3. The method as defined in claim 1, wherein said first ductility is at least 90 W/mK.

4. The method as defined in claim 1, wherein said cover layer has a melting point of at least 1600° C.

5. The method as defined in claim 1, wherein said intermediate layer is of a material selected from the group consisting of copper, nickel, cobalt and an alloy thereof.

* * * * *